US006619297B2

(12) United States Patent
Sheng

(10) Patent No.: US 6,619,297 B2
(45) Date of Patent: Sep. 16, 2003

(54) MULTI-LAYERED COSMETIC CASE

(76) Inventor: Wen-Cheng Sheng, No. 71, Lane 96, Da-Shing St., Tainan City (TW)

( * ) Notice: Subject to any disclaimer, the term of this patent is extended or adjusted under 35 U.S.C. 154(b) by 0 days.

(21) Appl. No.: 10/024,804

(22) Filed: Dec. 19, 2001

(65) Prior Publication Data

US 2002/0108628 A1 Aug. 15, 2002

(30) Foreign Application Priority Data

Feb. 14, 2001 (TW) ..... 90202229 U

(51) Int. Cl.[7] ..... A45D 33/20; B65D 6/00

(52) U.S. Cl. ..... 132/295; 220/4.27; 220/526; 206/581

(58) Field of Search ..... 132/295, 294, 132/297, 300; 220/4.27, 23.88, 4.26, 475, 526; 312/202, 269, 270.2, 300, 305, 308; 206/581; D28/78, 79

(56) References Cited

U.S. PATENT DOCUMENTS

| | | | | | |
|---|---|---|---|---|---|
| 245,855 | A | * | 8/1881 | Morrison | 433/79 |
| 1,289,657 | A | * | 12/1918 | Cheney | 312/201 |
| 1,460,950 | A | * | 7/1923 | Denney | 132/295 |
| 1,463,259 | A | * | 9/1923 | Flagg | 132/295 |
| 1,686,200 | A | * | 10/1928 | Cannard et al. | 132/295 |
| 2,429,290 | A | * | 10/1947 | Mueller | 312/326 |
| 2,663,608 | A | * | 12/1953 | Schauer | 312/326 |
| 3,392,868 | A | * | 7/1968 | Pfrommer | 220/520 |
| 3,441,033 | A | * | 4/1969 | Flax | 132/295 |
| 4,239,308 | A | * | 12/1980 | Bradley | 312/201 |
| 4,807,773 | A | * | 2/1989 | Tsai | 220/4 |
| 4,815,483 | A | * | 3/1989 | DuGrenier et al. | 132/295 |
| 5,025,817 | A | * | 6/1991 | Wen | 132/296 |
| 5,246,020 | A | * | 9/1993 | Wu | 132/295 |
| 5,370,255 | A | * | 12/1994 | Yang | 220/4.27 |
| 6,041,935 | A | * | 3/2000 | Yang | 206/581 |
| 6,070,749 | A | * | 6/2000 | Joulia | 220/4.22 |
| 6,145,515 | A | * | 11/2000 | Wu | 132/295 |
| D439,018 | S | * | 3/2001 | Fang | D28/77 |
| 6,223,921 | B1 | * | 5/2001 | Huang | 220/4.27 |
| 6,378,533 | B1 | * | 4/2002 | Roman | 132/295 |

* cited by examiner

*Primary Examiner*—Eduardo C. Robert
*Assistant Examiner*—David C. Comstock
(74) *Attorney, Agent, or Firm*—Christie, Parker & Hale, LLP

(57) ABSTRACT

A cosmetic case includes a frame unit and a stack of trays. The trays are mounted pivotally on the frame unit, and are turnable about a single axis to move between a closed position in which the trays are aligned with each other, and an open position in which the trays are out of alignment from each other. Each of the trays lags behind an adjacent one of the trays during turning movement of the trays, and has a first engaging member, a slide rail, and a second engaging member. The first engaging member of each of the trays is slidable along the slide rail and is engageable with the second engaging member of an adjacent one of the trays for subsequent simultaneous movement therebetween.

4 Claims, 7 Drawing Sheets

MULTI-LAYERED COSMETIC CASE

CROSS-REFERENCE TO RELATED APPLICATION

This application claims priority of Taiwan Patent Application No. 090202229, filed on Feb. 14, 2001.

BACKGROUND OF THE INVENTION

1. Field of the Invention

The invention relates to a cosmetic case, more particularly to a multi-layered cosmetic case.

2. Description of the Related Art

Referring to FIGS. 1 and 2, a conventional multi-layered cosmetic case is shown to comprise a horizontal base 91, a hollow pivot 92 disposed vertically on the base 91 proximate to an edge of the base 91, a stack of trays 93 pivotally connected to the pivot 92, and a top cover 94. The trays 93 are used for storing cosmetic items. The top cover 94 is disposed to cover the trays 93 when the latter are stacked in alignment.

Since the trays 93 are not interconnected to each other by engaging members, the trays 93 move independently so that only one tray 93 can be moved and opened at a time, as best illustrated in FIG. 2. Thus, the conventional multi-layered cosmetic case is inconvenient to use. Furthermore, the top cover 94 is easily misplaced.

SUMMARY OF THE INVENTION

Therefore, the main object of the present invention is to provide a multi-layered cosmetic case with a stack of trays that can be opened and closed simultaneously.

Accordingly, a multi-layered cosmetic case of the present invention comprises a frame unit and a stack of trays. The trays are mounted pivotally on the frame unit, and are turnable about a single axis to move between a closed position in which the trays are aligned with each other, and an open position in which the trays are out of alignment from each other. Each of the trays lags behind an adjacent one of the trays during turning movement of the trays, and has an open top with a top edge, a closed bottom, a first engaging member disposed at one of the top edge and the closed bottom, a slide rail disposed in the other one of the top edge and the closed bottom, and a second engaging member disposed adjacent to the slide rail. The first engaging member of each of the trays is slidable along the slide rail of the adjacent one of the trays for relative movement therebetween and subsequently engageable with the second engaging member of the adjacent one of the trays for subsequent simultaneous movement therebetween.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
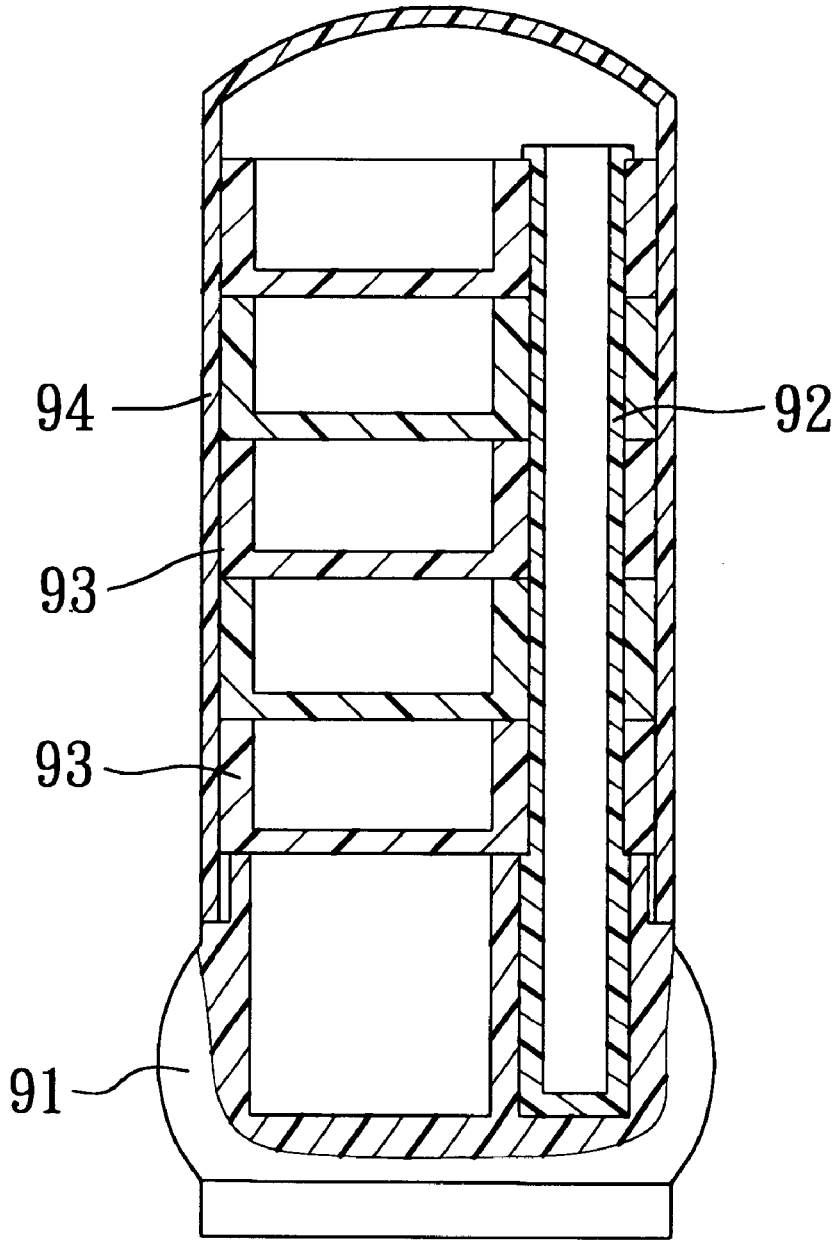
FIG. 1 PRIOR ART
FIG. 1 is an assembled sectional view of a conventional multi-layered cosmetic case.
Figure 2:
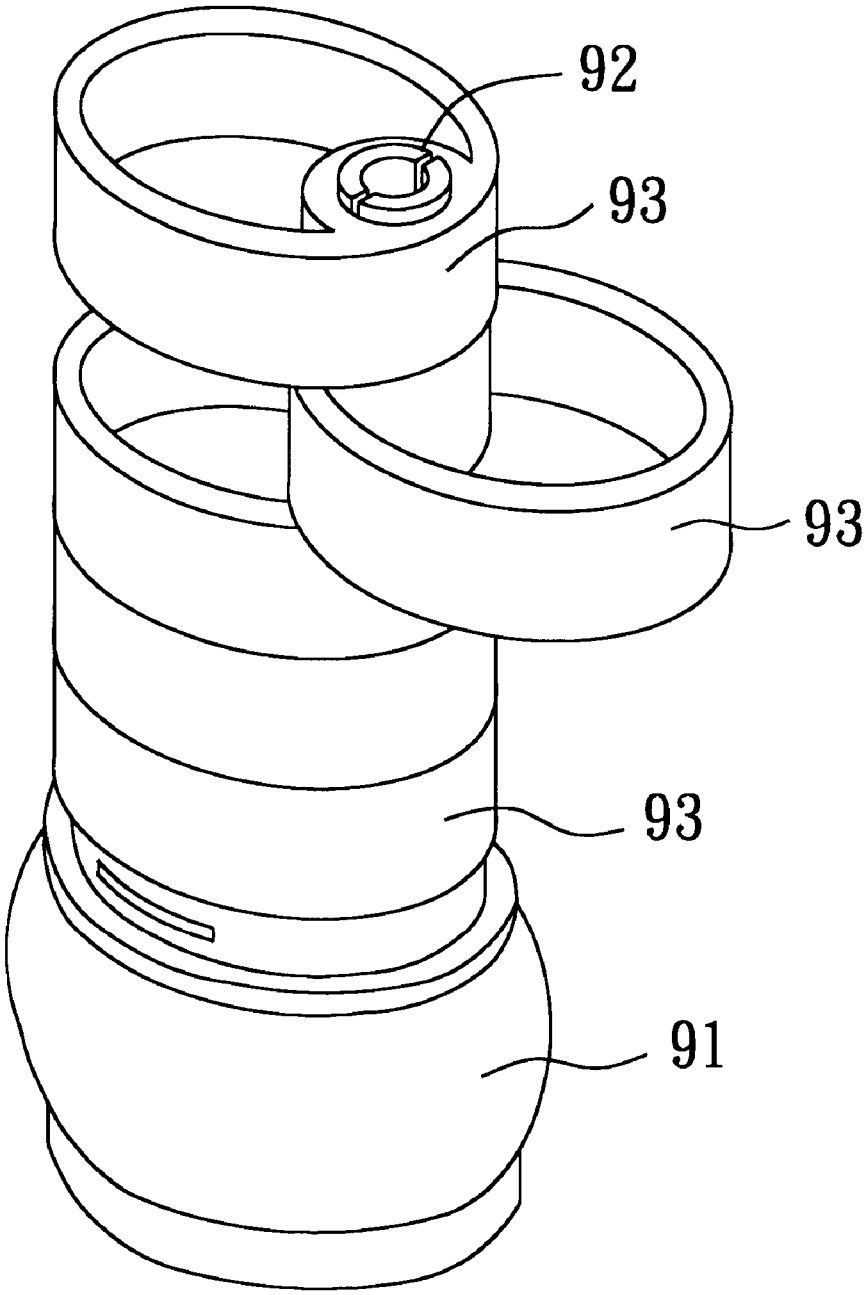
FIG. 2 PRIOR ART
FIG. 2 is a perspective view of the conventional cosmetic case of FIG. 1 in a state of use.
Figure 3:
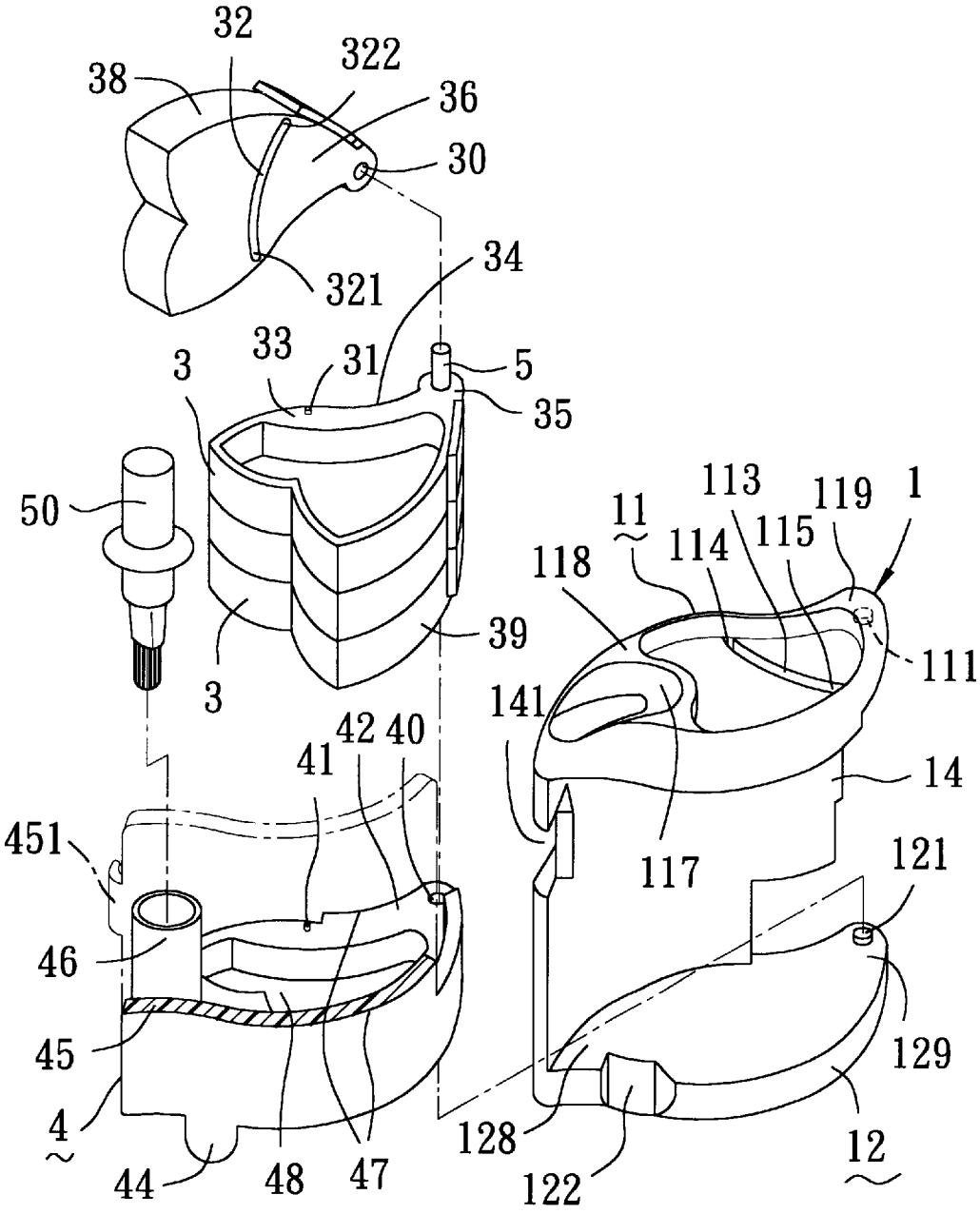
FIG. 3 is an exploded perspective view of the preferred embodiment of a multi-layered cosmetic case according to the present invention.
Figure 4:
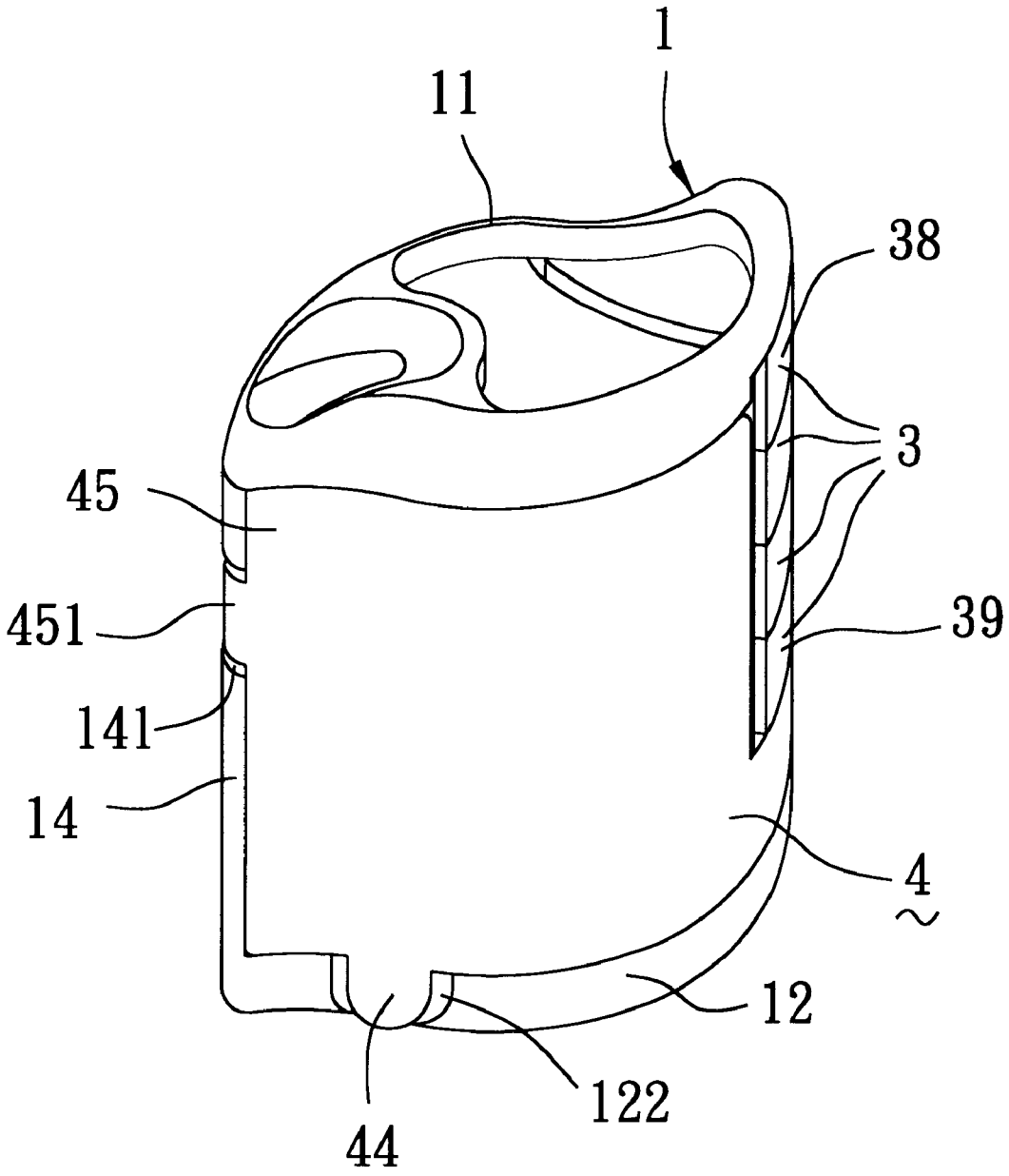
FIG. 4 is an assembled perspective view of the preferred embodiment.
Figure 5:
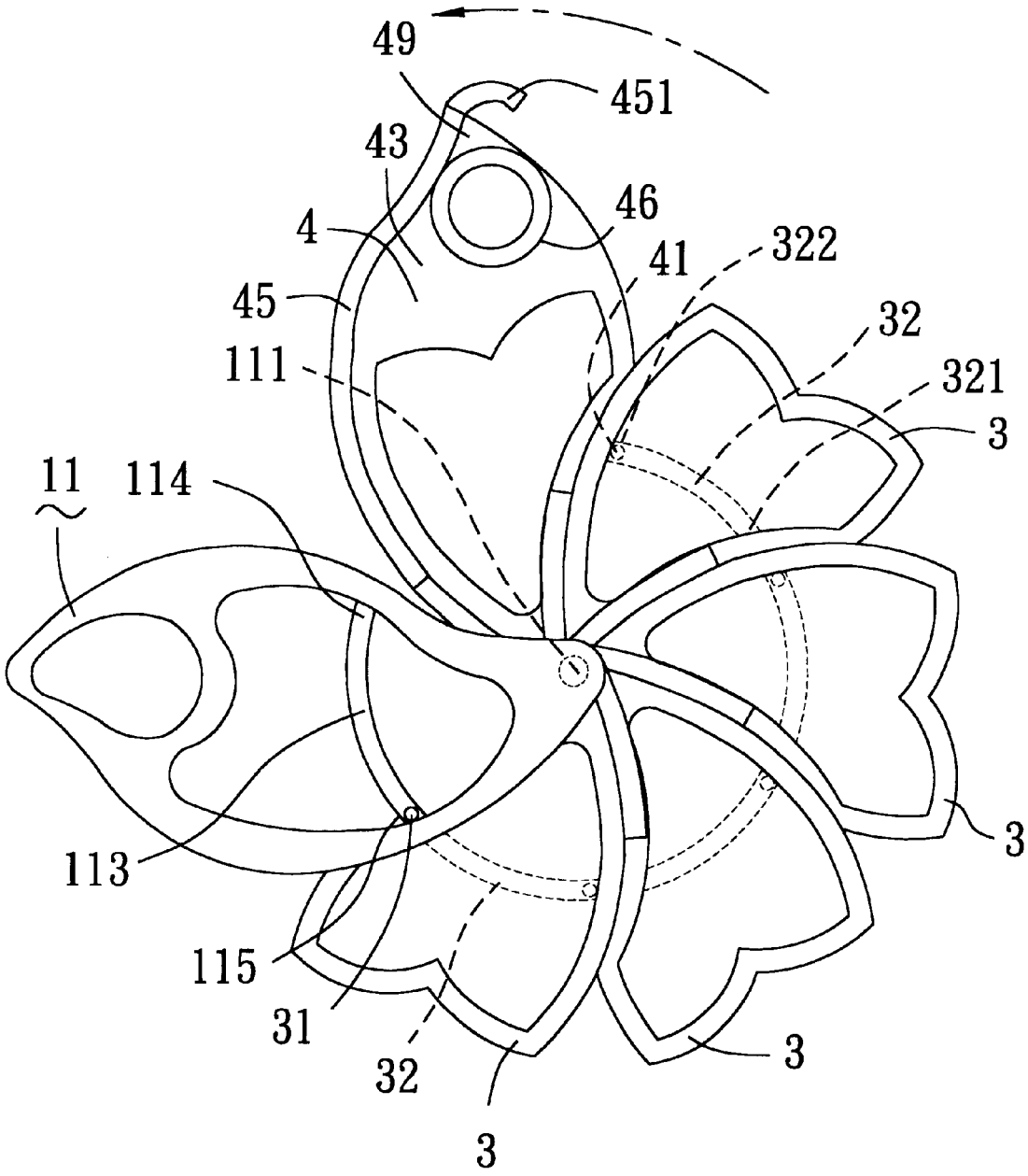
FIG. 5 is a schematic view of the preferred embodiment in an open state.

Referring to FIGS. 3 to 5, the preferred embodiment of a multi-layered cosmetic case according to the present invention is shown to comprise a frame unit 1, a stack of four first trays 3, and a second tray 4. The first and second trays 3, 4 are used for storing cosmetic items.

Each of the first trays 3 has a first pivot end 35 formed with a pivot hole 30, and two opposite first lateral sides 34. The lateral sides 34 of each of the first trays 3 extend from the first pivot end 35 in directions away from the first pivot end 35. A single pivot pin 5 extends through the pivot holes 30 in the first trays 3. Each of the first trays 3 further has an open top with a top edge 33, a closed bottom 36, a first engaging member in the form of a protrusion 31, and a slide rail in the form of an arc-shaped slot 32. The protrusion 31 of each of the first trays 3 projects upwardly from the top edge 33, and is disposed at one of the first lateral sides 34. The slot 32 in each of the first trays 3 extends from one of the first lateral sides 34 to the other one of the first lateral sides 34, and extends angularly in the closed bottom 36 about the pivot hole 30 to receive the protrusion 31 of an adjacent lower first tray 3. The slot 32 in each of the first trays 3 has two opposite ends 321, 322 that serve as second engaging members to engage the protrusion 31. The protrusion 31 of each of the first trays 3 is slidable along the slot 32 in the adjacent first tray 3 to permit relative movement between two adjacent first trays 3, and subsequently engages one of the opposite ends 321, 322 of the slot 32 to cause subsequent simultaneous movement of the adjacent first trays 3.

The frame unit 1 includes a top wall 11 extending above the first trays 3, a bottom wall 12 extending below the first trays 3, and a side wall 14 interconnecting the top and bottom walls 11, 12 and extending adjacent to one of the first lateral sides 34. The top wall 11 has a slot 113 which is similar in configuration to the slot 32 in each of the first trays 3 and which has two opposite engaging ends 114, 115.

The first trays 3 include an uppermost tray 38 disposed adjacent to the top wall 11 and connected pivotally to the top wall 11 via a pivot 111 and the pivot hole 30.

The second tray 4 is disposed on the bottom wall 12 below the first trays 3, and is connected pivotally to the bottom wall 12 via a pivot 121 and a pivot hole 40. The second tray 4 has a top edge formed with a protrusion 41 which is similar in configuration to the protrusion 31 of the first tray 3. The protrusion 41 is slidable along the slot 32 in the lowermost tray 39 of the first trays 3. The second tray 4 includes a second pivot end 42 substantially aligned with the first pivot ends 35, and two opposite second lateral sides 47 which substantially extend along the first lateral sides 34 but longer than the latter. The second tray 4 further has a cover wall 45, a distal end 49 (shown in FIG. 5), an extension region 43 (shown in FIG. 5), a tray recess 48, and a receptacle 46. The cover wall 45 extends at one of the second lateral sides 47 opposite to the side wall 14 of the frame unit 1, and projects upwardly to cover the first trays 3. The distal end 49 is opposite to the second pivot end 42. The extension region 43 is adjacent to the distal end 49. The tray recess 48 is in alignment with the first trays 3. The receptacle 46 is disposed in the extension region 43, and extends toward the top wall 11. The receptacle 46 is used for storing a cosmetic brush 50.

The first and second trays 3, 4 are interconnected via the pivot pin 5 which passes through the pivot holes 30 in the first trays and the pivot hole 40 in the second tray 4. The first and second trays 3, 4 are then mounted pivotally on the frame unit 1 by engaging the pivot hole 30 in the uppermost tray 38 with the pivot 111 of the top wall 11 and by engaging the pivot hole 40 in the second tray 4 with the pivot 121 of the bottom wall 12. The first and second trays 3, 4 and the top and bottom walls 11, 12 are now aligned and in a closed state.

The outer profiles of the top and bottom walls 11, 12 are substantially similar to that of the second tray 4. The top and bottom walls 11, 12 have the aligned pivots 111, 121 in the pivot ends 119, 129, and extension regions 118, 128 distal to the pivot ends 119, 129. The top wall 11 is further formed with a through hole 117 in the extension region 118 that is registered with the extension region 43 in the second tray 4.

The second tray 4 and the frame unit 1 are further provided with releasable interlocking elements such as a bottom tab 44, a locking groove 122, a side tab 451, and a locking notch 141. The bottom tab 44 projects downwardly from the cover wall 45, and engages releasably the locking groove 122. The side tab 451 projects sidewise, and engages releasably the locking notch 141. As such, the first and second trays 3, 4 can be retained in the closed state on the frame unit 1.

Figure 6:
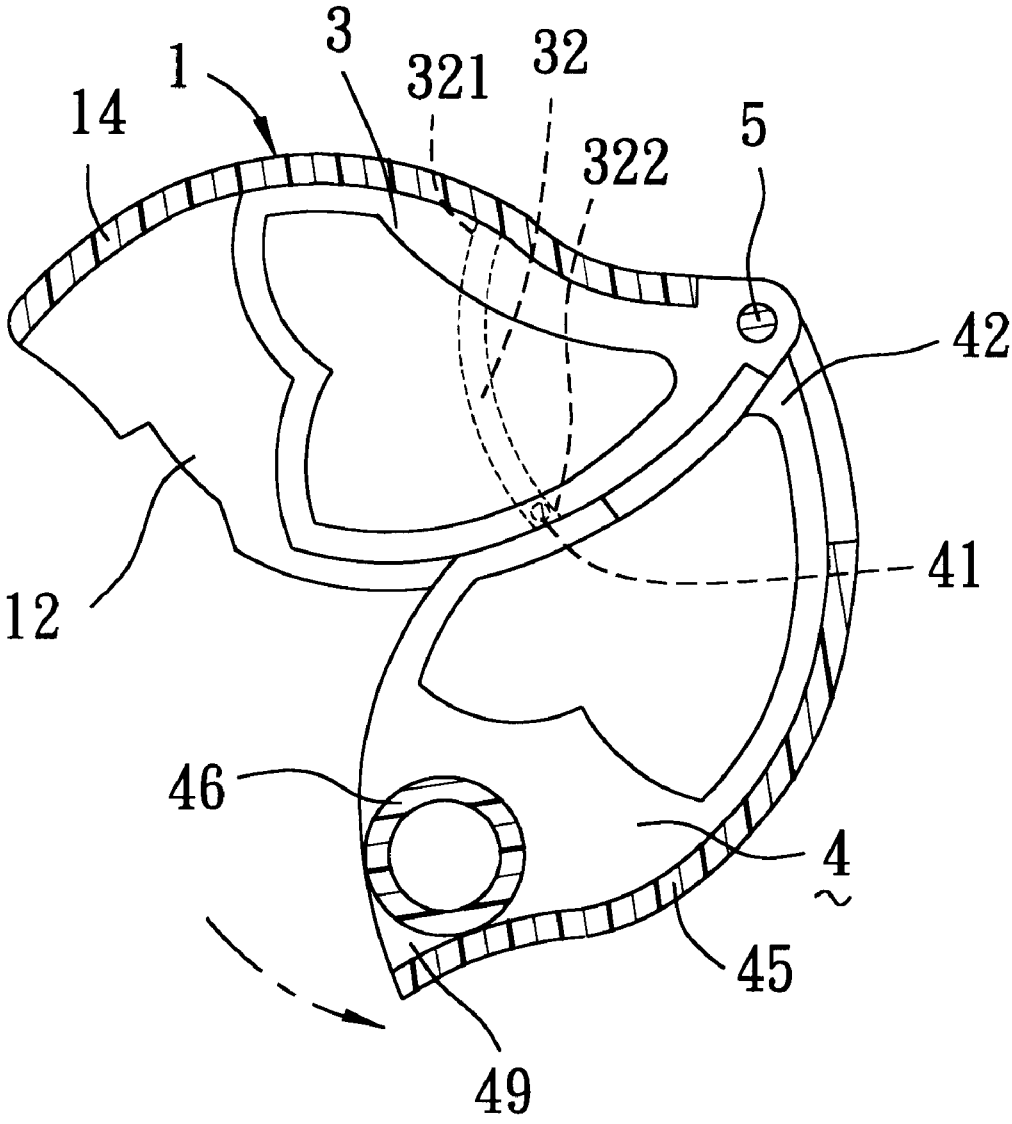
FIG. 6 is a sectional schematic view illustrating how a second tray causes a first tray to move to an open state.

In use, the bottom tab 44 of the second tray 4 or the side tab 451 of the cover wall 45 can be moved away from the locking groove 122 in the bottom wall 12 or the locking notch 141 in the side wall 14 with the use of a finger. At this time, the protrusion 41 of the second tray 4 moves from one end 321 to the other end 322 of the slot 32 in the lowermost tray 39. The lowermost tray 39 then moves after the second tray 4 has been turned by an angular distance. Similarly, the protrusion 31 of the lowermost tray 39 moves from one end 321 to the other end 322 of the slot 32 in the adjacent one of the first trays 3. The same movement occurs successively in the other first trays 3, such that each of the first trays 3 lags behind the adjacent one of the first trays 3 during turning movement of the trays 3, 4 about the pivot pin 5, as best illustrated in FIGS. 5 and 6. Finally, the protrusion 31 of the uppermost tray 38 abuts against one end 115 of the slot 113 in the top wall 11, and is retained thereat. The first and second trays 3, 4 are now opened, and are moved out of alignment from each other and from the frame unit 1 (see FIG. 5).

Figure 7:
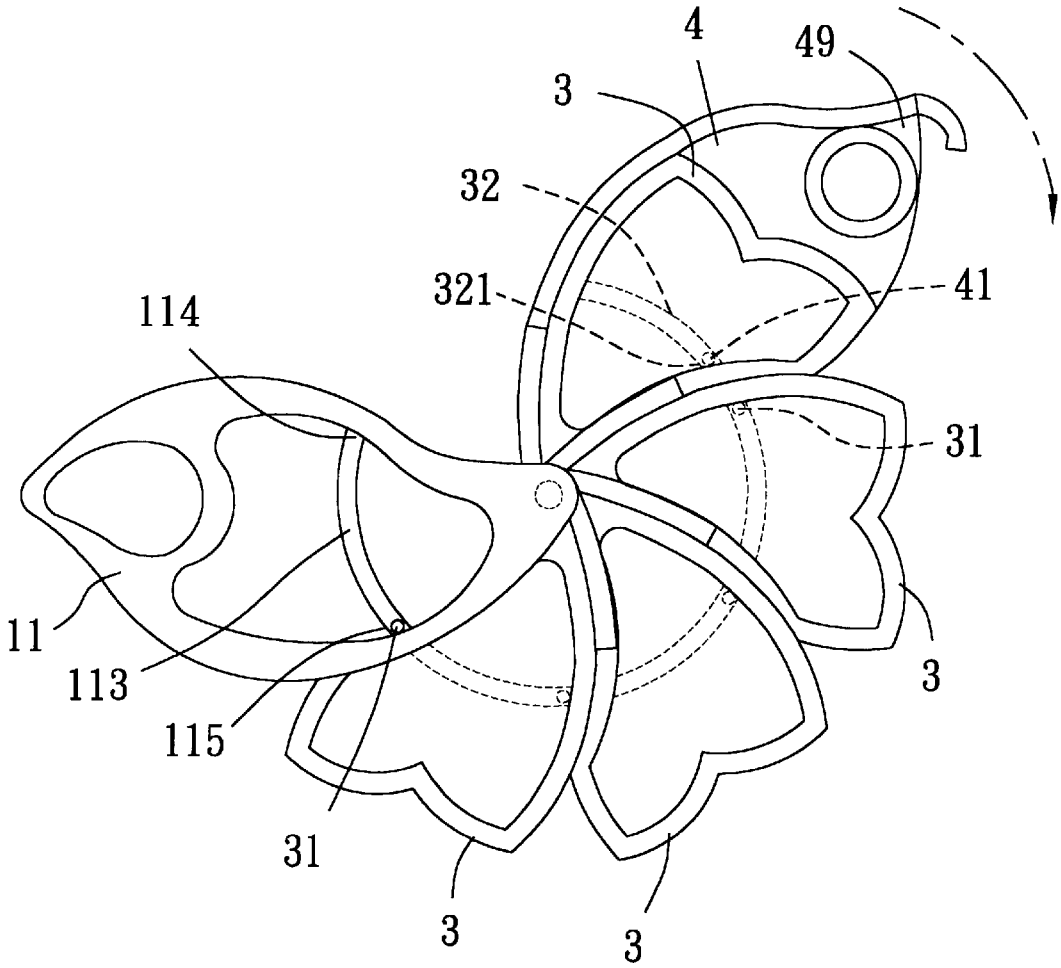
FIG. 7 is a schematic view illustrating how the trays are moved to a closed state.

When the protrusion 41 of the second tray 4 is moved in a reverse direction, that is, from the end 322 to the other end 321 of the slot 32 in the lowermost tray 39 of the first trays 3, the protrusion 3l of the lowermost tray 39 also moves from the end 322 to the other end 321 of the slot 32 in the adjacent one of the first trays 3. The other first trays 3 follow the same movement successively, as best illustrated in FIG. 7, until the protrusion 31 of the uppermost tray 38 of the first trays 3 abuts against the other end 114 of the slot 113 in the top wall 11. The first and second trays 3, 4 are now in a closed state, and are not only aligned with each other, but are also aligned with the top and bottom walls 11, 12 of the frame unit 1.

Therefore, the multi-layered cosmetic case of the present invention is easy to use because the trays 3, 4 can be opened and closed simultaneously.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A multi-layered cosmetic case comprising:

a frame unit; and a stack of first trays mounted pivotally on said frame unit, said first trays being turnable about a single axis to move between a closed position in which said first trays are aligned with each other, and an open position in which said first trays are out of alignment from each other, each of said first trays lagging behind an adjacent one of said first trays during turning movement of said first trays, each of said first trays having an open top with a top edge, a closed bottom, a first engaging member disposed at one of said top edge and said closed bottom, a slide rail disposed in the other one of said top edge and said closed bottom, and a second engaging member disposed adjacent to said slide rail, said first engaging member of each of said first trays being slidable along said slide rail of the adjacent one of said first trays for relative movement therebetween and being subsequently engageable with said second engaging member of the adjacent one of said first trays for subsequent simultaneous movement therebetween, wherein said first engaging member is formed as a protrusion projecting upwardly from said top edge, said slide rail being formed as an arc-shaped slot extending angularly in said closed bottom about said single axis to receive said protrusion of an adjacent lower one of said first trays, said slot having two opposite ends each defining said second engaging member to engage said first engaging member, wherein each of said first trays has a first pivot end, and two opposite first lateral sides extending from said first pivot end in directions away from said first pivot end, said slot extending from one of said first lateral sides to the other one of said first lateral sides, said protrusion being disposed at one of said first lateral sides, wherein said frame unit includes a top wall extending above said first trays, a bottom wall extending below said first trays, and a side wall interconnecting said top and bottom walls and extending adjacent to one of said lateral sides, wherein said first trays include an uppermost tray adjacent to said top wall and connected pivotally to said top wall about said single axis, said top wall having a slot which is similar in configuration to said slot in each of said first trays, further comprising a second tray disposed on said bottom wall below said first trays and connected pivotally about said single axis, said second tray having a top edge formed with a protrusion which is similar in configuration to said protrusion of each of said first trays, wherein said second tray includes a second pivot end substantially aligned with said first pivot ends, and two opposite second lateral sides substantially extending along said first lateral sides, wherein said second tray further has a cover wall extending at one of said second lateral sides opposite to said side wall of said frame unit and projecting upwardly to cover said first trays, and wherein said second lateral sides are longer than said first lateral sides, said second tray further having a distal end opposite to said second pivot end, and an extension region adjacent to said distal end, said second tray further having a tray recess in alignment with said first trays, and a receptacle disposed in said extension region of said second tray and extending toward said top wall.

2. The multi-layered cosmetic case as claimed in claim 1, further comprising releasable interlocking elements provided on said second tray and said frame unit.

3. The multi-layered cosmetic case as claimed in claim 2, wherein said interlocking elements include a bottom tab projecting downwardly from said cover wall, and a locking groove formed in said bottom wall for engaging releasably said bottom tab.

4. The multi-layered cosmetic case as claimed in claim 3, wherein said interlocking elements further include a side tab projecting sidewise from said cover wall, and a locking notch formed in said side wall for engaging releasably said side tab.

* * * * *